US006763561B2

(12) United States Patent
Sclippa

(10) Patent No.: US 6,763,561 B2
(45) Date of Patent: Jul. 20, 2004

(54) CONTINUOUS CASTING AND HOT ROLLING APPARATUS FOR PARALLEL PRODUCTION OF MULTIPLE METAL SHAPES

(75) Inventor: Ferruccio Sclippa, Tricesimo (IT)

(73) Assignee: SMS Demag Aktiengesellschaft, Dusseldorf (DE)

( * ) Notice: Subject to any disclaimer, the term of this patent is extended or adjusted under 35 U.S.C. 154(b) by 10 days.

(21) Appl. No.: 10/151,686

(22) Filed: May 20, 2002

(65) Prior Publication Data

US 2002/0189075 A1 Dec. 19, 2002

(51) Int. Cl.[7] ..... B21B 1/16

(52) U.S. Cl. ..... 29/33 C; 29/527.7; 72/204; 72/235

(58) Field of Search ..... 29/527.7, 33 C, 29/33 K, 335; 164/476, 417, 413, 454, 484, 442; 72/235, 203, 204, 201

(56) References Cited

U.S. PATENT DOCUMENTS 4,129,023 A * 12/1978 Sieurin ..... 72/235
5,303,766 A * 4/1994 Kreijger et al. ..... 29/527.7
6,035,682 A * 3/2000 Dorigo ..... 72/204
6,457,227 B1 * 10/2002 Nijveld et al. ..... 29/527.7
6,490,902 B2 * 12/2002 Sclippa ..... 72/235
6,568,056 B2 * 5/2003 Sclippa ..... 29/33 C
6,647,604 B2 * 11/2003 Sclippa ..... 29/33 C

FOREIGN PATENT DOCUMENTS

DE 4009861 A1 * 10/1991 ..... B21B/1/46
JP 57193205 A * 11/1982 ..... B21B/1/16

* cited by examiner

*Primary Examiner*—A. L. Wellington
*Assistant Examiner*—Dana Ross
(74) *Attorney, Agent, or Firm*—Herbert Dubno

(57) ABSTRACT

A continuous casting and hot rolling apparatus for the parallel production for a multiplicity of rolled shapes, wire and rod of circular, oval and polygonyl cross section in which a continuous caster or flow shaper produces initially a plurality of discreet strands which continuously are fed to a hot rolling line and then can be diverted, if desired to a universal rolling unit in which pairs of strands are rolled alternately in vertical and horizontal rolls. The unit may be driven by a common motor and can have drive shafts for the respective stands located at the vertices of an isosceles triangle.

7 Claims, 13 Drawing Sheets

CONTINUOUS CASTING AND HOT ROLLING APPARATUS FOR PARALLEL PRODUCTION OF MULTIPLE METAL SHAPES

FIELD OF THE INVENTION

The present invention relates to a continuous casting and hot rolling apparatus for the parallel production of different metal shapes, especially rods, wires and other rolled workpieces with a variety of cross sections.

BACKGROUND OF THE INVENTION

Continuous casting and hot rolling have been used for the production of elongated strands of a variety of shapes from many different metals.

In general, the strand is produced at a flow-shaping unit, e.g. a continuous caster, from which an elongated strand is withdrawn, e.g. between a pair of pinch or squeeze rolls which can engage the strand from opposite sides.

The initial shape of the strand is imparted by the casting mold or by some other die or the like through which the metal is forced, e.g. by the extraction of the shaped strand at the discharge end or by the application of pressure at the inlet end.

The strand is rolled, usually after cutting into billets, to reduce its cross section, i.e. so as to make the workpiece thinner in at least one transverse dimension and to modify, if desired, the cross sectional shape. The rolling process may require a number of passes or passage through a succession of roll stands, or both, until the desired cross section is achieved.

With small cross section products, especially wire and rod, the processing becomes more cost intensive and more complex the number of reduction stages to which the strand must be subject becomes greater. To maintain a reasonable productivity, roll speeds must be increased continuously or stepwise from relatively slow speeds of the order of meters per minute to speeds of say 30 m/sec in the case of straight metal sections or shapes or 100 m/sec in the case of spooled metal wire, or more.

Efforts to increase these speeds have encountered barriers which are not easily overcome without increasing production and maintenance costs. Thus the operating speeds have limited productivity of lines for producing such products.

To overcome this drawback it has been proposed to utilize parallel production of metal shapes or at least parallel rolling techniques starting from the continuously cast product and running to the billets or bloom stage. These techniques, however, in spite of their potential for significant increase in the productivity of a processing line have not found major industrial application because of the complexity.

One of the problems faced in prior approaches is that when the rolls of the rolling line engage one of the strands or workpieces properly for cross section reduction, the rolls tend to jam with a second strand or workpiece, do not effectively roll the latter, create difficulties with respect to the rolling of the latter or make it impossible for the rolls to be fully effective with the second workpiece.

As a consequence, when billets have been rolled in a parallel production system, a split rolling process has been used. In this approach (see, for example, JP-A-60-130401), the rolled billet to be subdivided is reduced in cross section at a junction region and then split into two strands. The strands are then individually rotated through 90° and rolled to reduce their cross sections along dimensions at right angles to the previous reduction and to the final thickness.

Utilizing this approach two or three workpieces can be split from an initial rolled billet.

It is also possible to form four steel strands by this general approach utilizing two successive splits with the same roll system and starting from the same kind of billet. For example, with this process a steel billet whose cross section may be 160 mm×160 mm from the heating furnace can be split into a multiplicity of workpieces and the rolled products can be obtained with an hourly production rate of for example 37 tons per hour.

This process must operate with roll speeds of the order of 3 m/min or 0.05 m/sec. In practice such roll speeds cannot be supported by many of the roll stands in use and as a result the product is replete with defects, has a large number of rejects and cannot be produced without detriment to the rolls in terms of overheating.

Furthermore, if one starts with a billet of 160 mm×160 mm in cross section to produce circular section rod or wire of a diameter of 8.5 mm for example, approximately 18 roll stands are required and the cost of the process line and operating same may be prohibitive. For such a system to be productive, the speed of the billet in the first mill stand must be about three times greater than the maximum continuous casting speed of such a billet and thus a continuous casting supply of the strand for this type of split strand rolling is impossible.

In German Patent Document 40 098 61A, a rolling line is described for the production of steel rod and in which the rolling line acts directly on a plurality of strands which derive from a continuously cast strip divided downstream of the continuous caster into the plurality of billets.

In JP 57-193205, a flat product is likewise subdivided into a multiplicity of billets which ultimately are separated from one another after having been transformed into rectangular portions located in diagonal relationship to one another and connected at corners of the respective cross section. In this case, the subdivision is not effected in conjunction with a continuous casting. Indeed, the flattened slab is initially subjected in a primarily rolling to a predetermined cross sectional reduction and reduction of thickness prior to the subdivision and is grooved in subsequent rollings before being split.

This latter approach is a discontinuous approach not unlikely the others described in the background hereto.

In EP 08 76 225, a method and hot rolling plant is described for the continuous production of bar, rod or wire which utilizes a continuous caster directly upstream of a rolling line and likewise produces individual slab-shaped continuous castings which are then transformed subsequently into respective products in the rod, wire or bar category by a slab splitting.

In the latter approach, a continuous caster serves as the source of the initial slab and is followed by a hot rolling line which ultimately produces the separate parallel-made products in the form of bar, rod or wire.

The rolling portion of the line comprises a first rolling unit for rolling the continuously cast slab with progressive reduction in cross section. The second rolling unit, with opposing grooved rolls, serves to produce a longitudinally grooved slab.

Upstream of the first rolling unit, EP 0 876 225 provides:

A continuous caster which continuously supplies the flat slab or bloom having a thickness less than 80 mm, preferably about 50 nm and adapted to be subdivided into the individual product units;

an induction furnace of tunnel shape, also referred to as an induction tunnel or as an equalizing furnace, for heating the advancing flat bloom or slab from the continuous caster to a hot rolling temperature;

an edging mill for the lateral rolling and having vertical rollers for shaping the advancing heated bloom or slab to impart to it an exact uniform width;

a splitting unit following the aforementioned second rolling unit for subdividing the advancing uniform-width bloom along longitudinal lines into a multiplicity of strips, bars or workpieces which can be shaped in parallel and can form the parallel-produced products bar rotators for rotating the resulting plurality or multiplicity of bars or strips by 90°; and finishing roll units or stands with opposite angularly grooved rolls for the continuous production in parallel of a corresponding number of sectioned bars, rods or wires.

The drawbacks of that system, among others which have been mentioned with respect to the earlier systems, include the need for prerolling a flat slab or bloom. That prerolling step, which normally changes the rectangular shape of the continuously cast bloom to provided a somewhat oval or rhomboid shape and which requires both longitudinal and lateral rolling, it is complicated and expensive. This system, moreover, also may require the longitudinal division of the continuously cast strand to form the discrete blooms.

However, the system does have the advantage that the prerolling of the continuously case material before subdividing it into lengths, orients the fibers in the rolled material so that elongated fibers which are aligned in the longitudinal direction are formed, thereby improving the uniformity of the products which are obtained and the strength of the products.

OBJECTS OF THE INVENTION

It is the principal object of the present invention to provide an improved apparatus, plant or processing line, especially for the production of steel products, which enables metal rod or wire or structural shapes of a variety of cross sections of different size of shape to be produced by hot rolling at rolling speeds which are more effective than have been achievable heretofore, at high production rates and in an economical manner.

It is another object of the invention to provide an improved apparatus for the parallel production of steel rod and wire which eliminates drawbacks of the split strand method.

Still another object of this invention is to provide an apparatus which improved upon that described in EP 0 876 225 both in terms of the product rate and the types of products which can be produced and heat has the advantage of producing elongated workpieces of high strength.

SUMMARY OF THE INVENTION

These objects are achieved, in accordance with the invention, in a continuous casting and hot rolling apparatus for the parallel production of a multiplicity of different metal shapes, which comprise a continuous caster having n flow shaping unit with a multistrand mold for casting respective continuous metal strands of different cross sections, where n is an even number but at least equal to 2 or >2;

an extractor including at least one pair of pinch rollers below the caster for drawing the strands from the molds;

a tunnel-shaped preheating induction furnace downstream of the extractor and traversed by the strands for heating the strands to hot-rolling temperature;

a hot-rolling line downstream of the induction furnace and comprising a multiplicity of roll stands successively engaging the strands and having rolls oriented for reducing cross sections of the strands in at least two different directions so that a width of 60 to 70 mm of each strands is reduced to about 12 mm with an increase of peripheral speed of the rolls at an inlet to the line of about 14 m/min to a peripheral speed of the rolls of about 12 m/sec at an outlet of the line;

at least n/2 universal rolling units downstream of the hot-rolling line and each comprised of 12 roll-pair groups oriented in isosceles triangle patterns and each traversed by two parallel and opposite ones of the strands for rolling same with a final peripheral roll speed of about 85 m/sec; and loop control systems between the hot-rolling line and the apparatus upstream thereof and between the hot-rolling line and the units for compensating for speed variations between relatively upstream and downstream parts of the apparatus.

The flow shaping unit constituted by the continuous caster, of the invention, is capable of producing at least four mutually adjacent but geometrically different strands and small n can thus be an even number greater than 2, for example, 4, 6, 8, . . . . The reference to a flow-shaping unit or flow-shaping bore is intended to mean a bore in a continuous casting die which may be separated from the other bores thereof or may be a continuous casting die which itself is separate from other continuous casting dies but is capable of producing a continuous strand proximal to the other strands. It also may be some other flow-shaping passage and can be provided with pinch or squeezing rolls individual to the particular strand and the strand which emerges from the squeezing or pinch rolls can have round, oval or polygonal shapes. The shapes can be different from strand to strand or different from one group of strands to another group of strands.

The preheating furnace which has been described can be a tunnel shaped induction furnace of the type used in EP 0 876 225.

The loop control system or systems which have been described are intended to allow compensation between the upstream and downstream segments of the apparatus in terms of the speeds of the strands through them. The loop control system or systems is described in greater detail below.

In a preferred embodiment of the invention, in the hot rolling line, the rolling stands can provide six horizontal rolls and the mill stands are provided to permit rotation of the rolling directions through 90° between successive passes or segments. The rolls of successive segments can thus be oriented at 90° relative to one another, i.e. can be alternately horizontal and vertical rolls or can be provided such that the workpieces can be rotated through 90° between successive passes. Advantageously, the mill stands of the hot rolling line include both horizontally and vertically oriented rolls and encompass at least a number of vertical roll pairs disposed in two parallel mutually adjacent rows, each of which forms a rolling channel which can be offset from one another by about half the axial spacing so that each row can include n/2 vertical roll pairs which are alternately used for the two rolling channels.

In an embodiment of the invention the rolling line can consist of six horizontal rolls which can alternate or be replaced by vertical rolls upon a rotation through 90°.

The system allows multiple rod, wire and structure shapes to be produced in a very compact apparatus.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
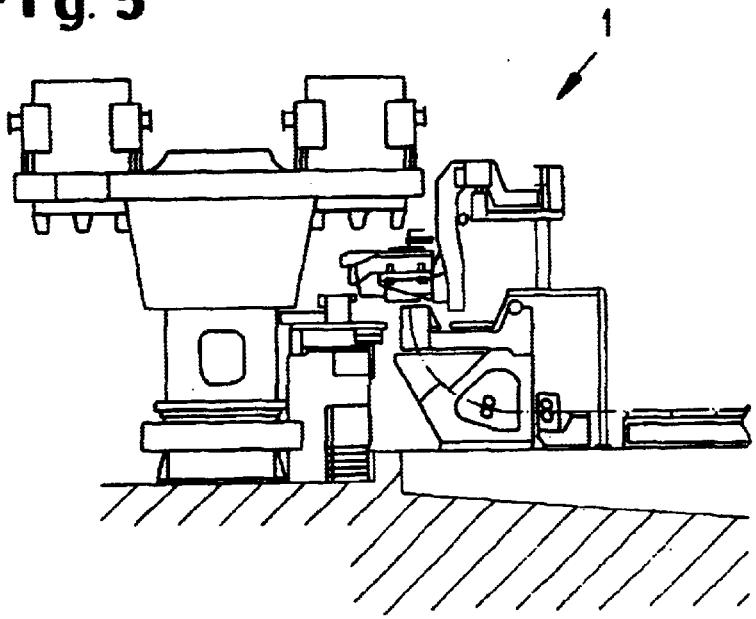
FIG. 5 is a side view of the continuous casting or flow shaping part of the apparatus.
Figure 5A:
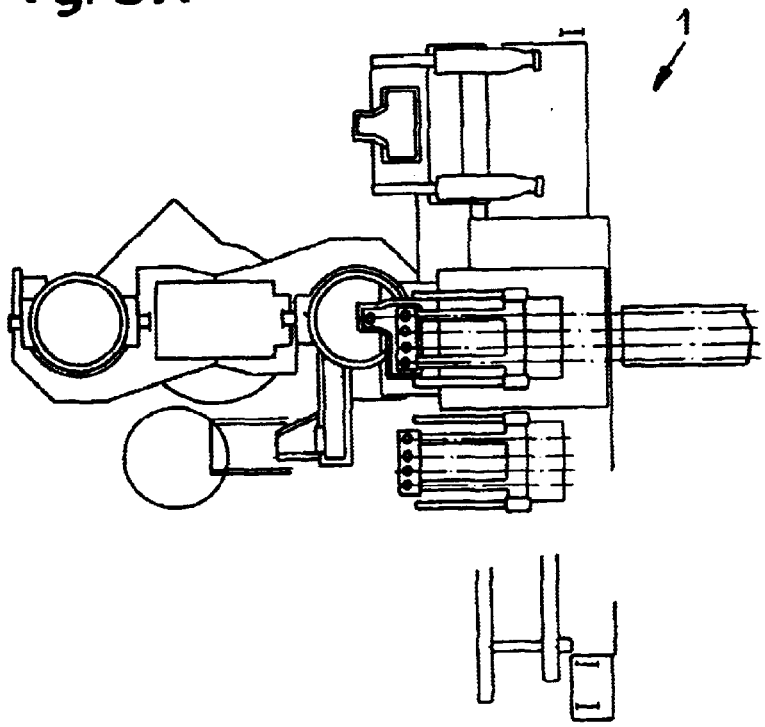
FIG. 5*a* is a plan view of the portion of the apparatus shown in FIG. 5.
Figure 5B:
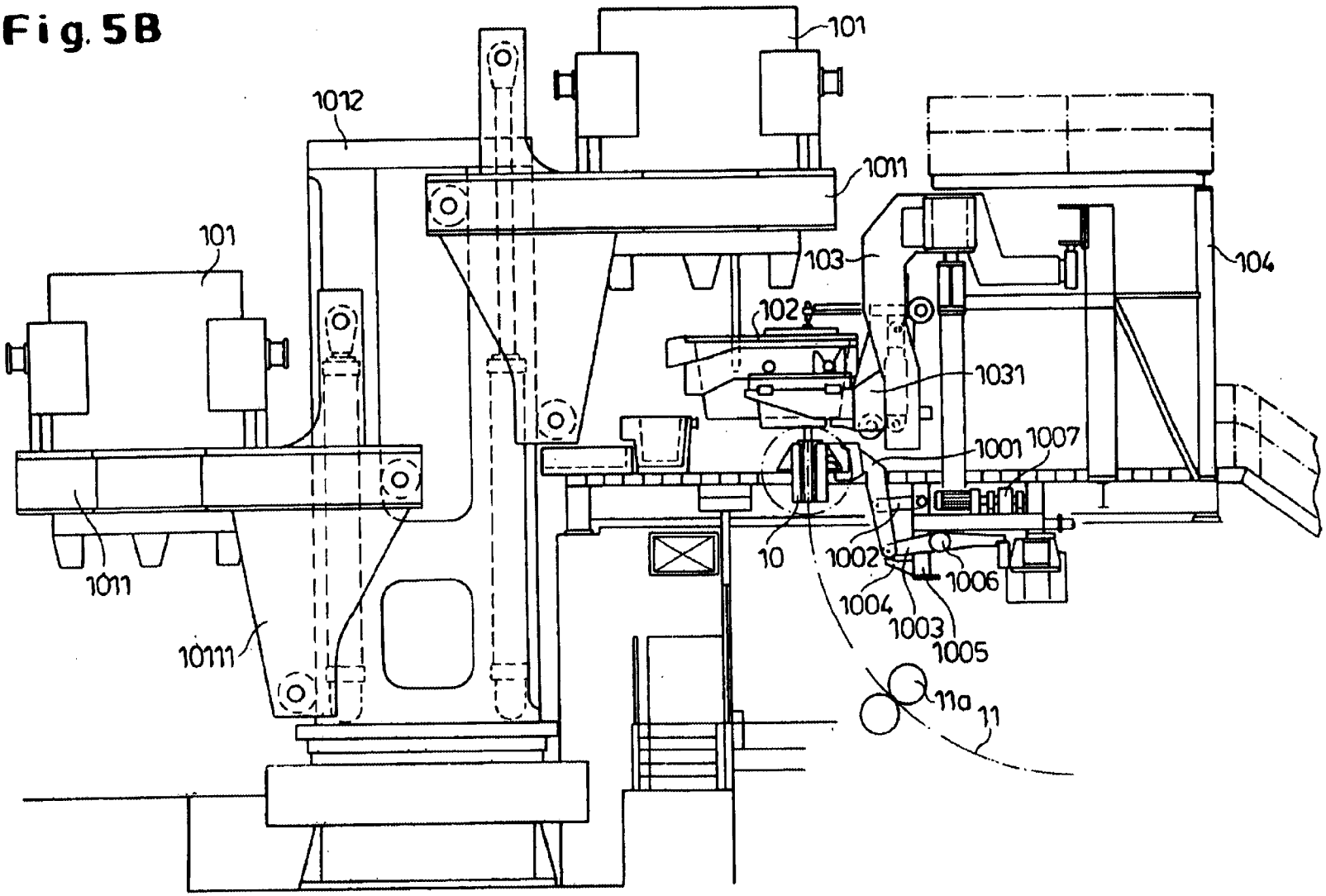
FIG. 5*b* is a detailed view as seen in the same direction as in FIG. 5 of the continuous casting portion.
Figure 5D:
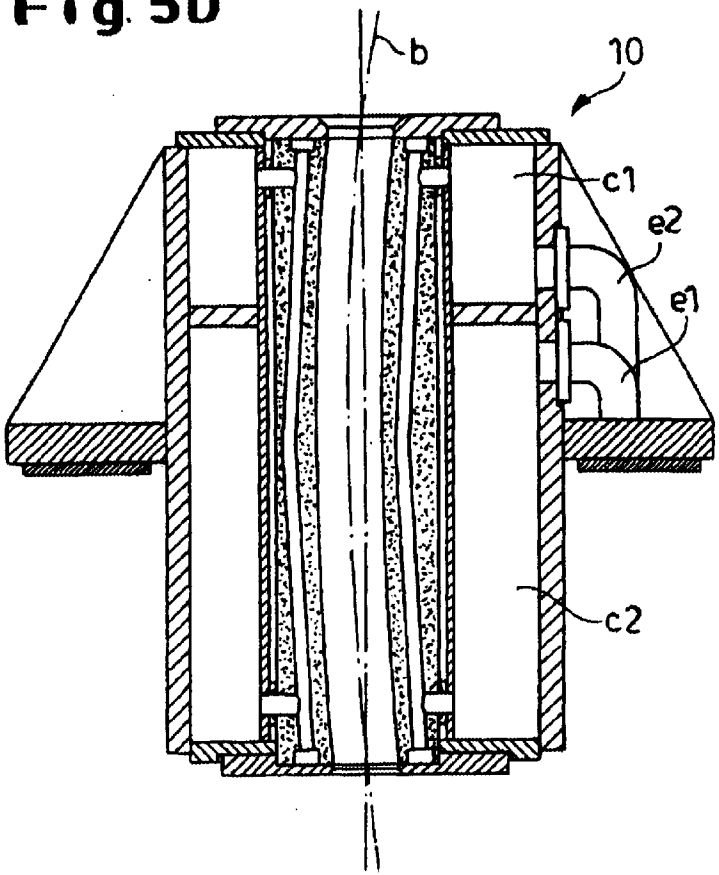
FIG. 5*d* is a vertical section through the portion of the apparatus of FIG. 5*c;*
Figure 5C:
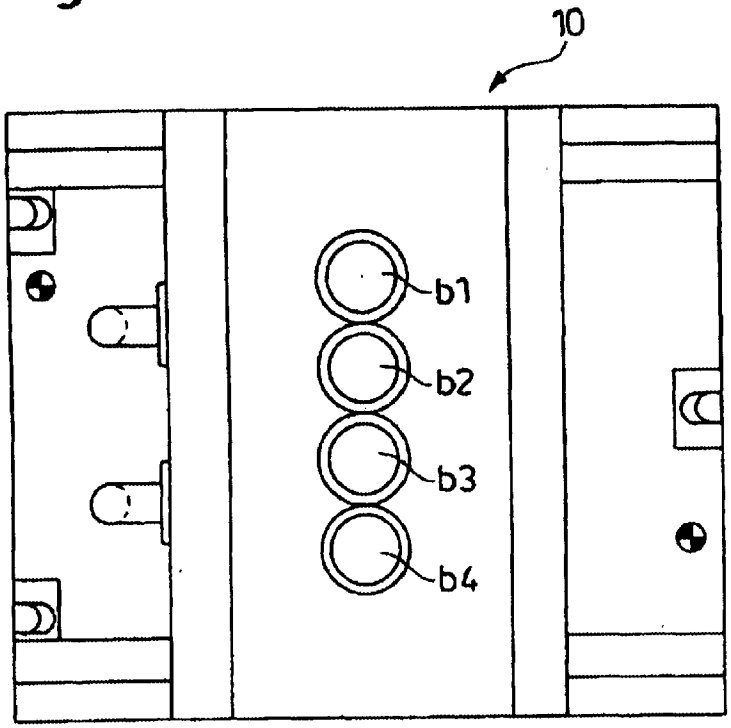
FIG. 5*c* is a plan view showing the flow shaping unit with multistrand mold.
Figure 6:
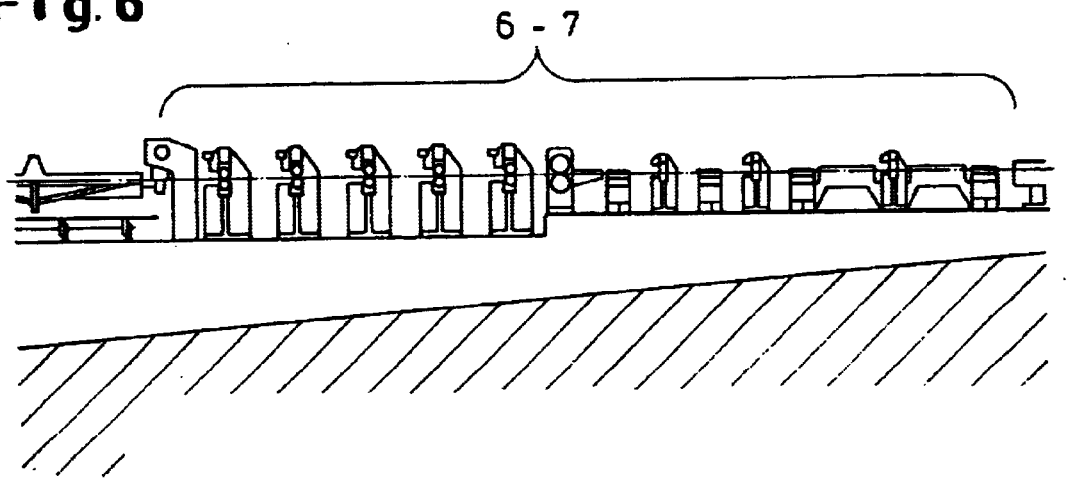
FIG. 6 is a side elevational view in the region of the hot rolling line.
Figure 6B:
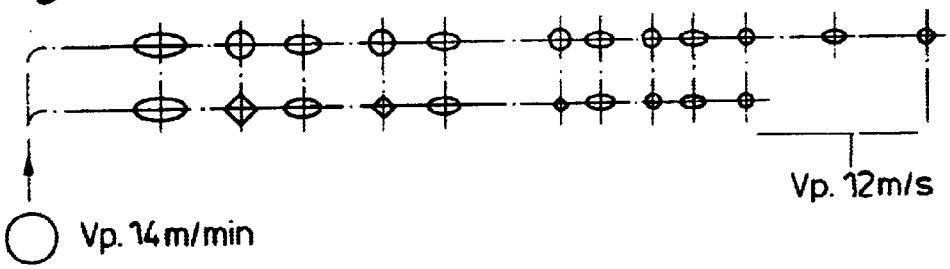
FIG. 6*b* is a diagram similar to that of FIG. 4 showing rolling sections and speeds.
Figure 6A:
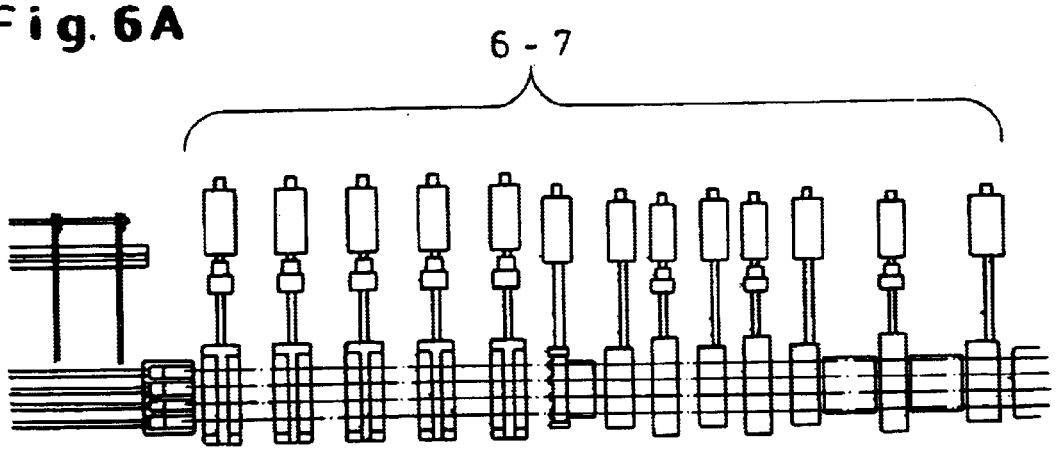
FIG. 6*a* is a plan view of this portion of the hot rolling line.

In FIGS. 1, 2 and 1*a*, 2*a*, the flow-shaping unit of the apparatus has been shown as a continuous caster which is described in greater detail hereinafter. The shaping portion 10 (FIGS. 5*c* and 5*d*) can comprise, in the embodiment shown, mold multistrand producing strands b1, b2, b3, b4 which are shown to be generally vertical passages and which produce parallel strands of possibly different cross sectional shapes at the outset. These strands may have different shapes and can be rolled to different products such as polygonal wire or rod, circular wire or rod, and oval wire or rod. The strands coming out of the passages b1 to b4 are separate from one another from their formation.

The strands pass along the continuous caster cooling line represented at 11 and are engaged along that line between pinch and squeezing rolls as represented diagrammatically at 11*a*. Sets of these rolls may be provided along the path 11 and, if desired, part of that path may be formed by a roller bed as shown at 11*b* in FIG. 3. The pinch rolls form an extractor 2 included at last one pair of pinch rolls below the caster for drawing the strands from the molds. An emergency cutting unit 3 can be provided for transversely cutting the strands, Downstream of the extractor 2 and the emergency cutter 3, I provided an after heating tunnel 5 with inductive heaters and in which the advanced strands are brought to the homogenization and hot rolling temperature.

Figure 2:
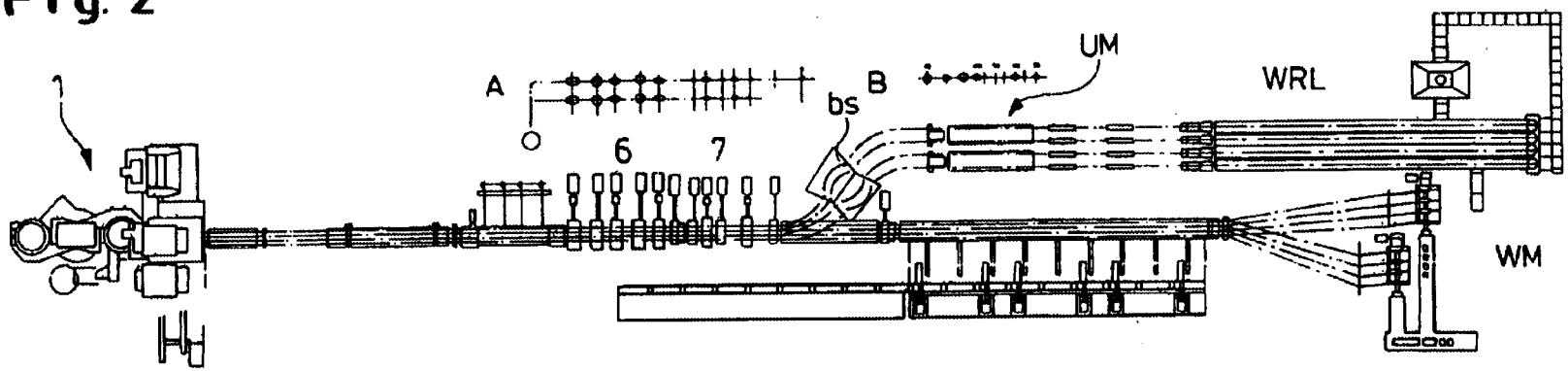
FIG. 2 is a diagrammatic plan view of the apparatus of FIG. 1 rolling mill H/V.
Figure 1A:
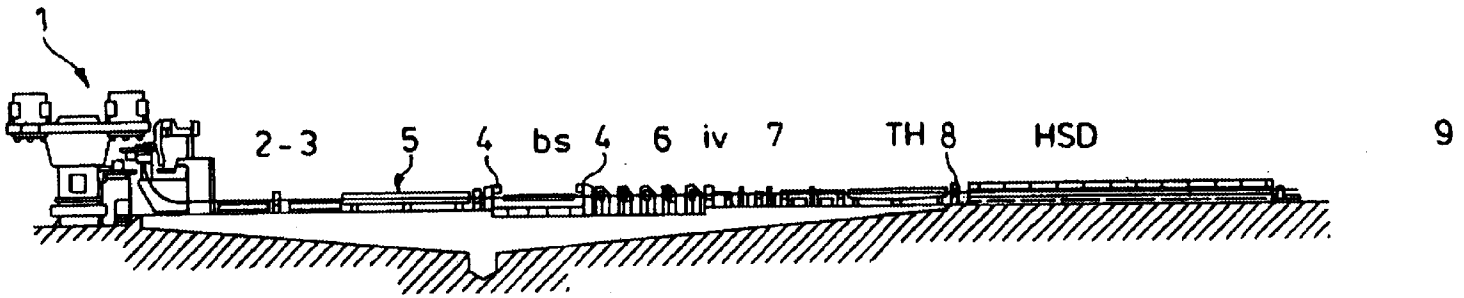
FIG. 1*a* is a variant of FIG. 1.
Figure 2A:
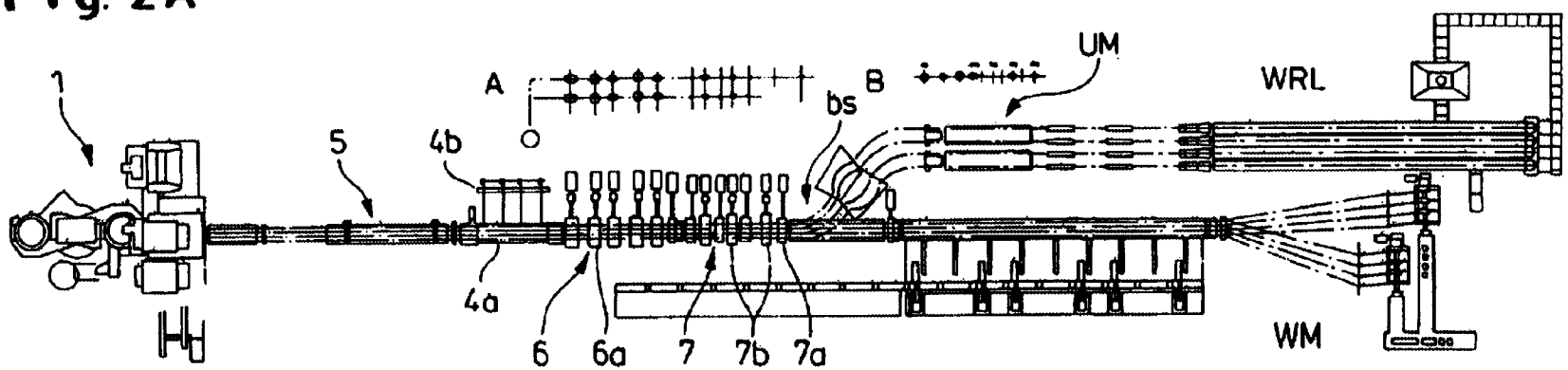
FIG. 2*a* is a diagrammatic plan view of the apparatus of FIG. 1A rolling mill H.
Figure 9A:
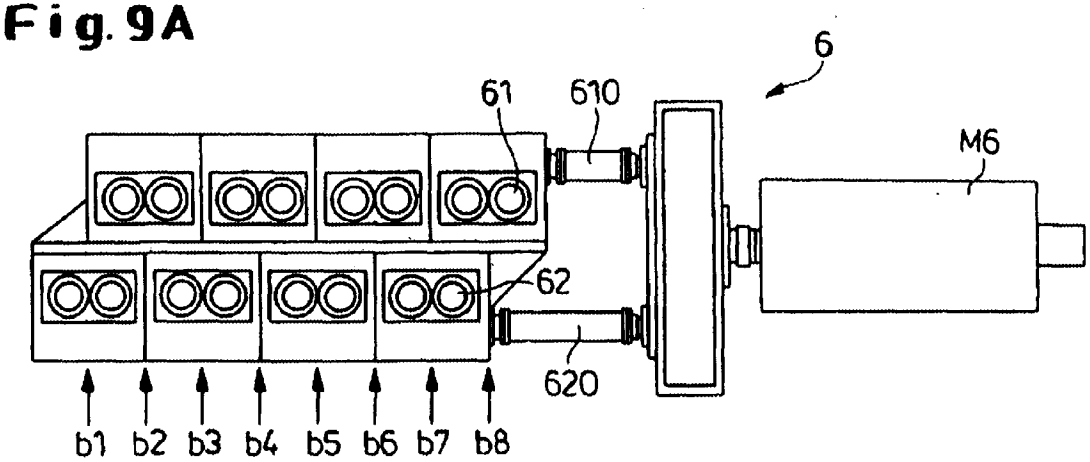
FIG. 9*a* is a plan view thereof.
Figure 9:
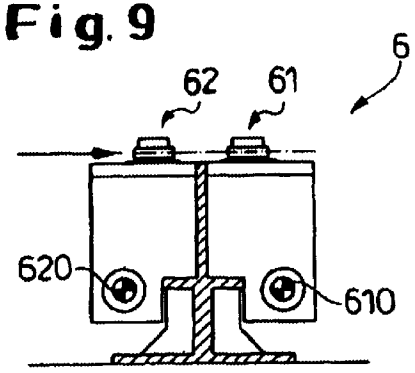
FIG. 9 is a side view of the vertical roll stand with two rows of offset roll pairs as in FIGS. 1*a* and 2*a;*
Figure 9C:
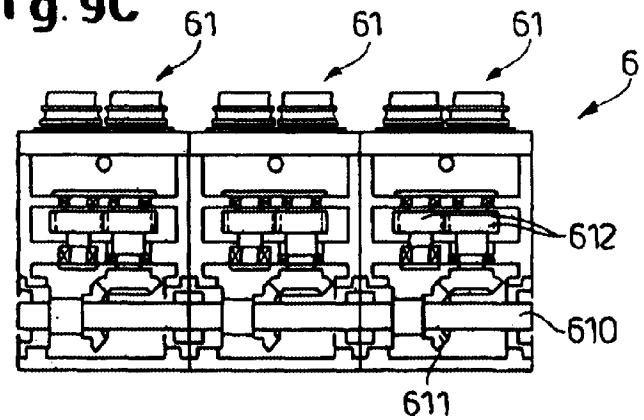
FIG. 9*c* is a front cross section of a vertical mill frame.
Figure 9B:
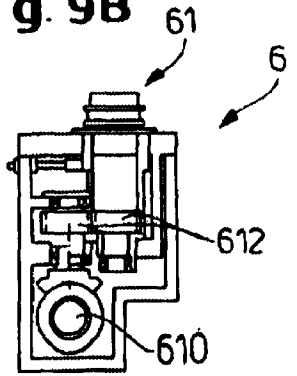
FIG. 9*b* is a lateral cross sectional view thereof.

Downstream of the heating tunnel 5 are shears 4*a* at which reject portions can be cut off shifted laterally and collected at 4*b* (FIG. 2*a*). The heated strands pass first into a hot rolling line 6 and then to the hot rolling line 7. Line 6 comprises 5 roll stands 6*a* with horizontal rolls and line 7 comprises 4 roll stands 7*a* with vertical and roll stands 7*b* alternating therewith having horizontal rolls. The vertical rolls stands are subdivided into two mutually offset roll pairs. If there are n parallel product lines there are thus n/2 numbers of pairs. The horizontal rolls each have n rolling grooves and can alternate with 90° rotators represented at iv in the drawing. Following the rolling stage and at the end of the process line is a zone 9 referred to as the end zone (FIG. 1A and FIG. 9) and in which the rolled wire can be spooled on reels of type WM, WR and RR, all conventional in the wire and rod production process. The segment HSD is an aftertreatment segment of the line for the aftertreatment of the rolled products and can be an annealing, pickling or like stage or can include a number of stages conventional in wire, rod and thin shape processing.

The section WRL (FIGS. 2 and 2*a* can be a conventional wire rod line which terminates in a system for winding up the wire on spools in a conventional manner.

The storage compartments (hot coil boxes) or more generally loop speed controllers represented by the letters bs are located where required to provide a loop control which synchronizes the speeds upstream and downstream from the hot coil boxes. The loop control permits the speeds upstream and downstream of the loop control to vary from one another.

Downstream from the hot rolling line 6, 7, is a further shaped tunnel for the cooling and heat treatment of the strand.

Turning to FIGS. 5, 5*a*, 5*b*, 5*c* and 5*d*, it can be seen that the flow shaping members or molds b1, b2, b3, b4 . . . $b_n$ of the flow shaping unit 10 can comprise individual shaping passages that are mutually adjacent to directly produce discrete or individual, mutually separated strands. Since no slab is required with the present invention, even initially, the entire apparatus can be made more compact than earlier lines for the parallel production of rolled products.

Figure 7A:
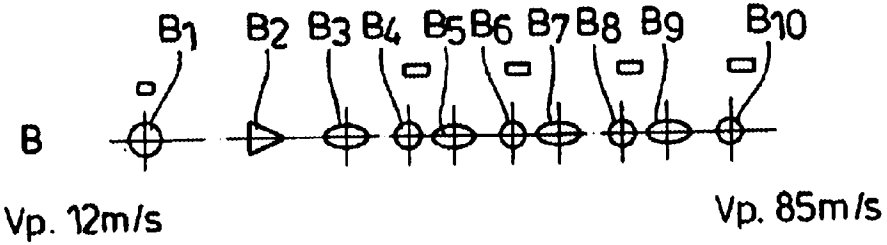
FIG. 7*a* is a diagram similar to that of FIG. 4 for this unit.
Figure 7:
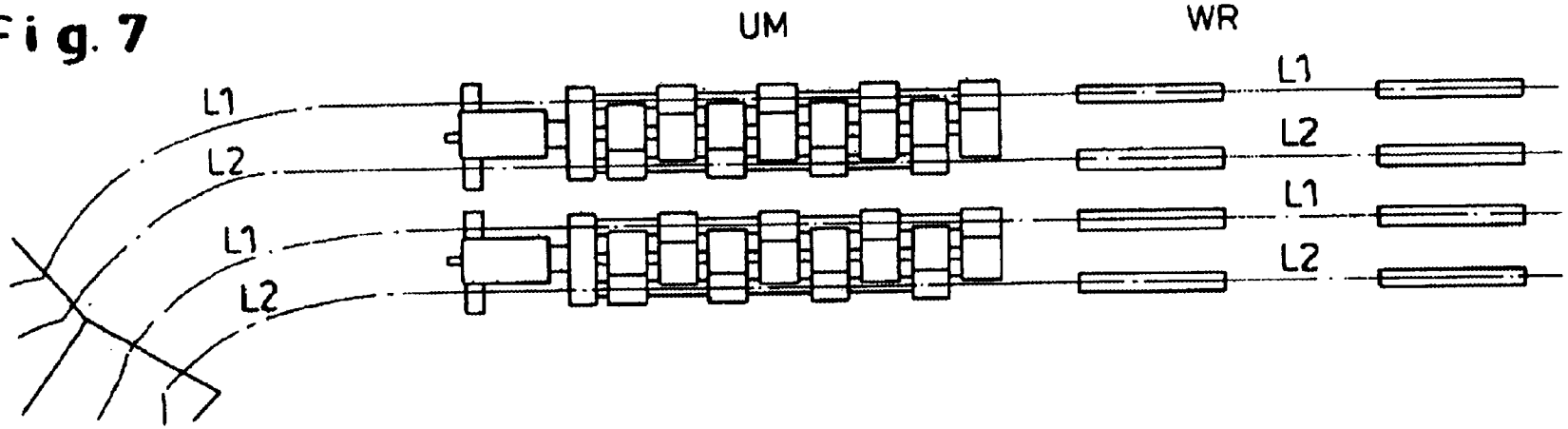
FIG. 7 is a plan view of the universal units UM of the apparatus of FIGS. 1*a* and 2*a;*
Figure 7B:
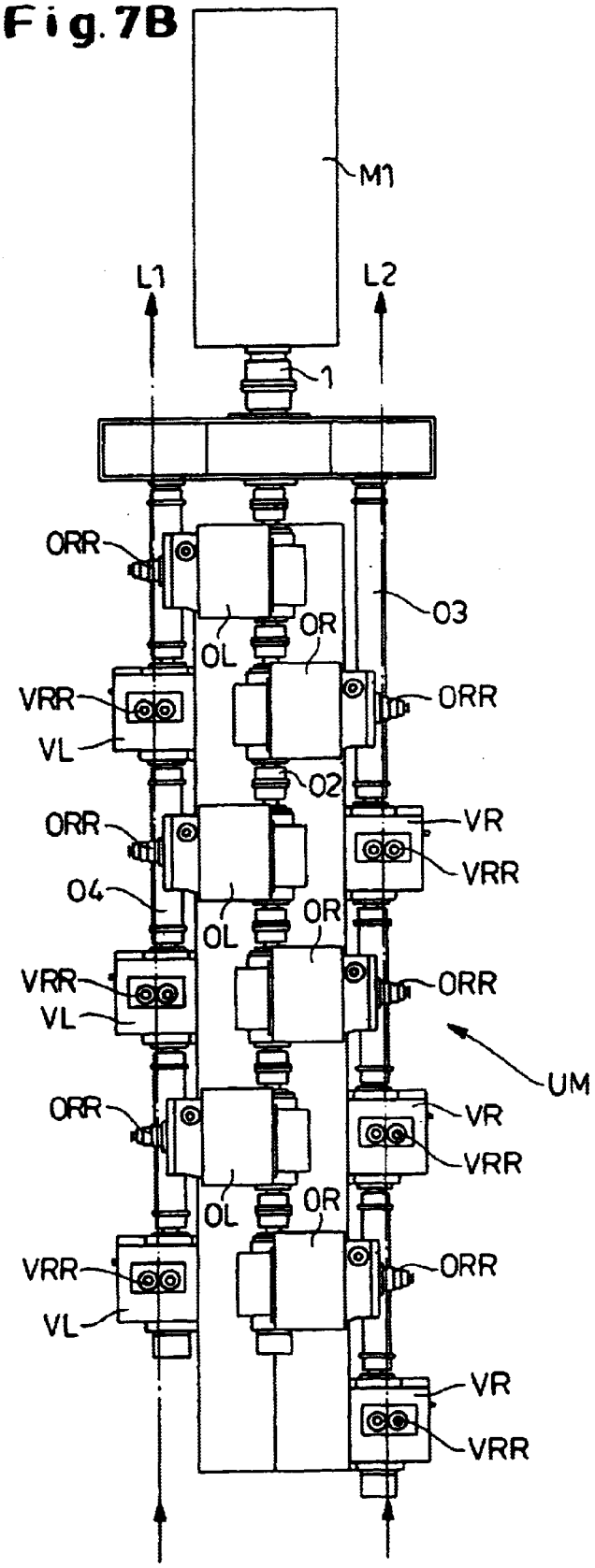
FIG. 7*b* is a detailed plan view for one UM universal unit.

In FIG. 7*b*, a mill stand arrangement has been shown which has a multiplicity of vertical mill rolls (see also FIG.

9*a* and, according to an important feature of this invention, all of these vertical mill rolls can be driven by a single motor.

With respect to the continuous caster, which plays the role of the flow forming part of the apparatus, it can be seen that the continuous casting molds disposed at 10 may have casting ladles 101 mounted on a turn table or rotor structure to enable the ladles to supply a tundish 102 whose outlet nozzles can communicate with the individual passages b1, b2, b3 . . . bn.

The ladles 101 are, therefore, mounted on vertically disposable carriages 1011 carried by supports 10111 guided on the rotatable column 1012. The tundish 102 is, in turn, associated with a lateral bridge structure 104 carrying the parts 103 and 1031 of the continuous caster.

The continuous casting mold system 10 is itself mounted on a lever mechanism 1001, 1002, 1003, 1004, 1005, 1006 powered by a motor drive 1007. The curved line b of the continuous casting mold 10 is visible. The continuous casting flow shaping unit has two separate cooling chambers c1, c2 in which water of different temperatures is circulated as represented at e1, e2. This allows for better control of the continuous casting parameters. Naturally two or more mold units of the above described type can be provided.

By way of illustration, the system allows eight strands, for example, as represented at b1 . . . b8 to be produced and thus a corresponding amount of the cast steel of the cast iron to be introduced.

The vertical rolling stands (see especially FIGS. 9, 9*a*, 9*b* and 9*c*). Have two rows of vertical roll pairs 61, 62 with each row of pairs being driven by a respective drive shift 610, 620 from a single motor M6. Each pair of rolls has meshing cylindrical gears and a number of the rollers in a row have bevel gears meshing with gears on the common shaft, e.g. the shaft 610 in FIG. 9*c*.

Figure 8A:
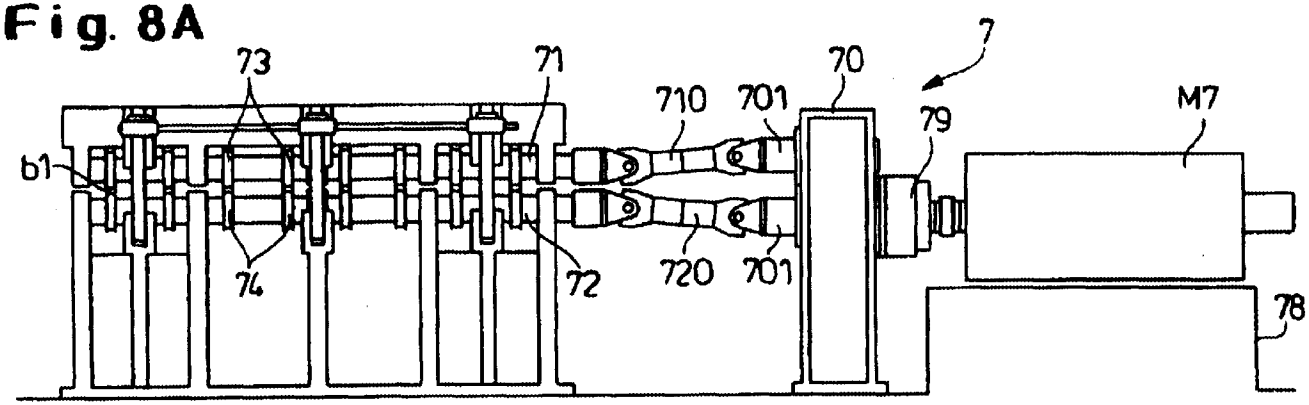
FIG. 8*a* is an end view of the stand.

Alternatively, rotation is transferred by means of a first roller pair row to the next or second roller pair row (61' with 62', 62' with 61', 622 with 61' etc.). The horizontal roll stands 7 (FIGS. 8, 8*a* and 8*b*) have respective pairs of drive shafts 710, 720, also driven by a common or single motor M7 and equipped to drive the respective rolls 71 and 72. The latter have grooves 73 and 74 for the respective strands b1 . . . b8 (FIG. 8*b*).

Figure 8:
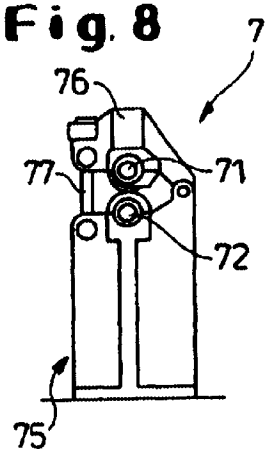
FIG. 8 is a side view of a horizontal roll stand illustrated in FIGS. 1 and 2.
Figure 8B:
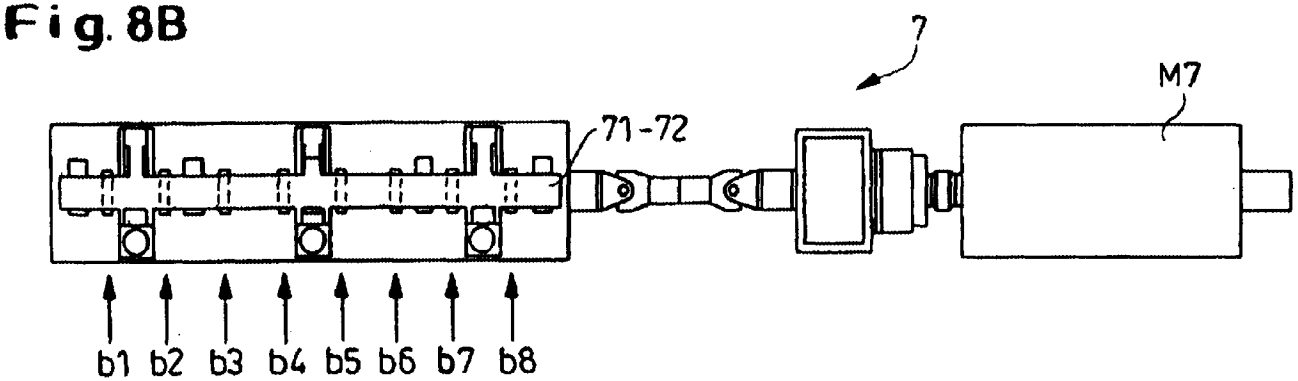
FIG. 8*b* is a top plan view of the latter stand.

As can be seen in FIG. 8, the stand 7 comprises a base 75 carrying the lower roller 72 and an arm 76 carrying the upper roller 71 and secured by a drawbolt 77 to determine the force with which the rod or strand is rolled. The motor M7 can be mounted on a foundation 78 and drives an input shaft 79 for the transmission 70 whose output shafts 701 are connected to the shafts 710, 720 which are formed as universal coupling shafts.

Figure 3:
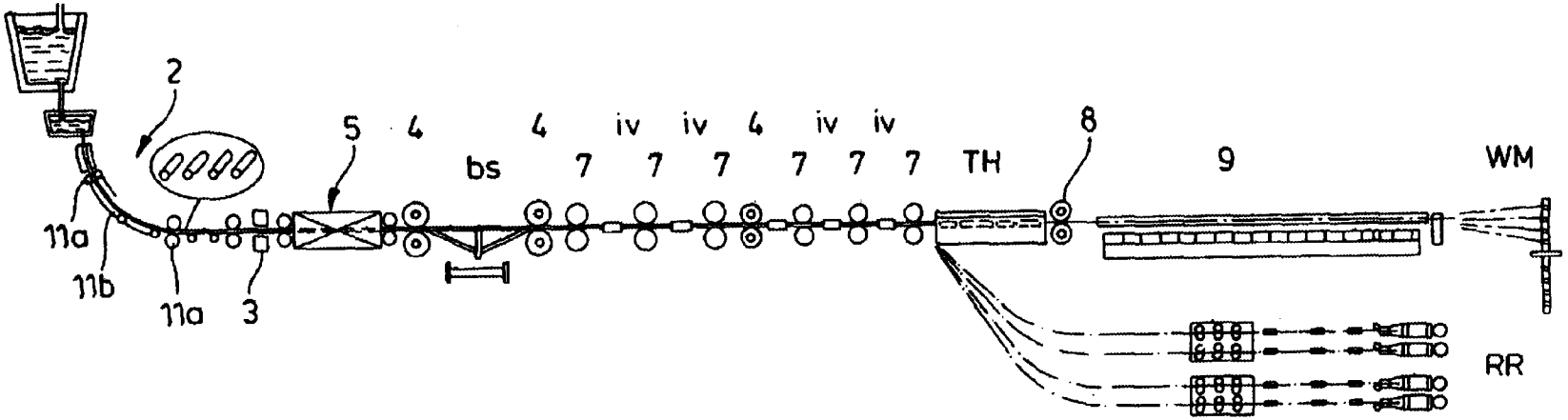
FIG. 3 is a schematic illustration of a portion of the apparatus with rolling mill with horizontal and vertical stands.

Downstream of the thermal treatment at TH, a shear 8 (FIGS. 1, 1*a* and 3) is provided, upstream of the wire rolling line WRL and the reel stand WM (see FIGS. 2*a* and 3).

The end product, therefore, can be wire which is collected in reels or spools along a side path, bar stock which continues directly in line and can have larger cross sections, and wire coils formed at RR.

Advantageously and according to an important feature of the invention, the hot coil boxes or compensating chambers bs which can form wire or rod loops, allow compensation for the different speeds between the continuous casting stage and subsequently, between rolling stages and between rolling stages and cutting and further processing stages, i.e. generally between upstream and downstream segments of the path operating at different speeds. The storage can involve loop formation in the strand.

Figure 7C:
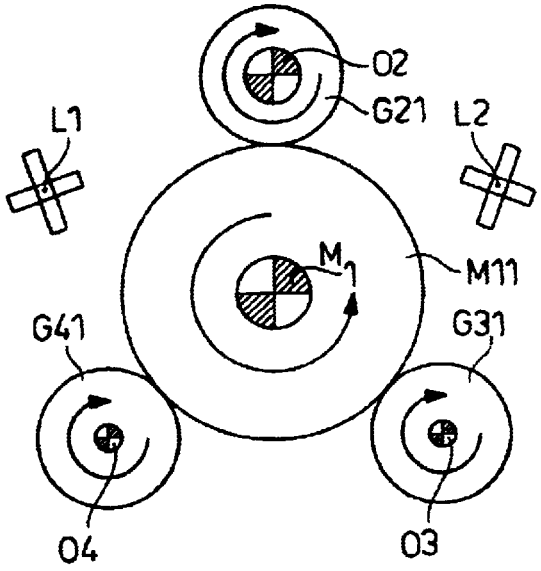
FIG. 7*c* is a diagrammatic vertical section showing the drive motor pattern for the universal unit.
Figure 7D:
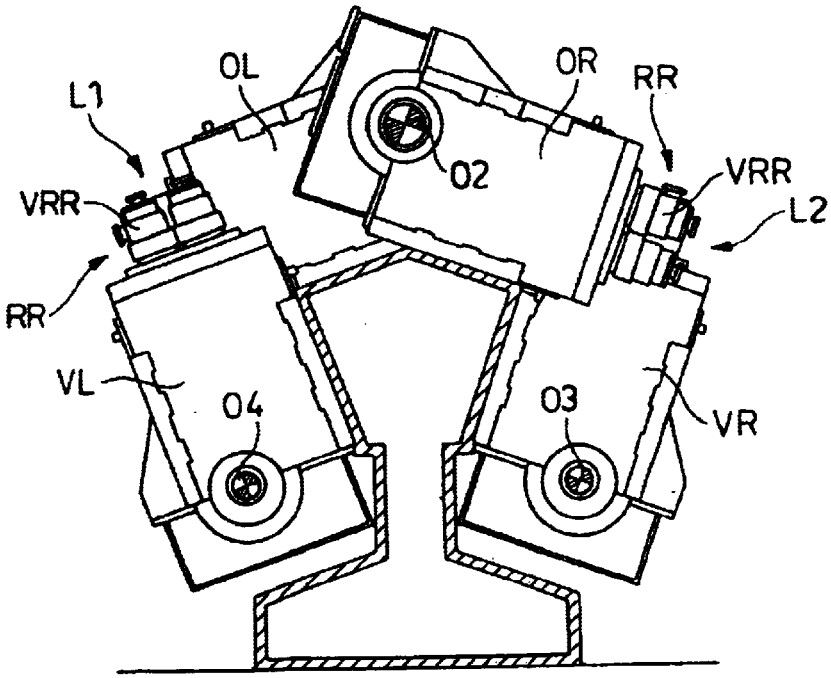
FIG. 7*d* is an end view illustrating the layout of the rolling units.

The wire rolling line WR or WRL is comprised (see especially FIGS. 2 and 2*a*), of two laterally disposed compact rolling units with two horizontal parallel rolling lines, each of which comprises (FIGS. 7, 7*a*, 7*b*, 7*c*) three rim driven transmission shafts 02, 03 and 04, e.g. of planetary transmissions driven by a common motor (m1) and located at the vertices of an isosceles triangle and of which the lower shafts 03 and 04 drive outwardly inclined vertical mill rolls VL & VR while the upper rim driven shaft drives an oppositely inclined mill (OL, OR) with horizontal rolls and whose rolls extend at right angles 2, but overlap the aforementioned rolling lines which have been represented at L1 and L2 (compare FIGS. 7*c* and 7*d*).

The unit along the wire rolling line WR or WRL is thus a universal mill which comprises a single motor m1 whose individual motor axis drives a transmission represented diagrammatically at $m_{11}$ which can be considered, in its simplified form, to mesh with three pinion gears $G_{21}$, $G_{31}$, $G_{41}$ for aforementioned rim driven shafts 02, 03 and 04 and the respective mill frame OR, VR, VL and hence the respective pairs of rollers. The pairs of rollers are generically represented at $V_{rr}$.

Two of the shafts (03 and 04) are located at the vertices of a base of an equilateral triangle and the third shaft 02 lies at the upper vertex of that equilateral triangle. The mills VR and VL respectively provide vertical rolls for the right hand line L2 and the lefthand line L1 while the rolls ORR of the units OR and OL affect the horizontal rolling of the strands along lines L1 and L2 respectively. The units OR and OL are alternately oriented to the right and to the left along their common drive shaft 02. All of the vertical and horizontal rolls at the right hand side are thus oriented along the line L2 while all of the rolls at the left hand side are oriented along the line L1. Since half of the rolling units are oriented on the left side and half on the right side, only half as many units are provided with the shafts 03 and 04 and a full compliment of such units is provided along the upper shaft 02. As can be seen in FIG. 7*c*, the axes of the shafts 02, 03 and 04, taken together with the axes of line L1 and L2 form a pentagon. The pentagon can preferably be an equilateral pentagon. With the system of the invention, moreover, the mill stands can reduce the workpieces from about 12 mm round to about 4 mm round or less.

Figure 1:
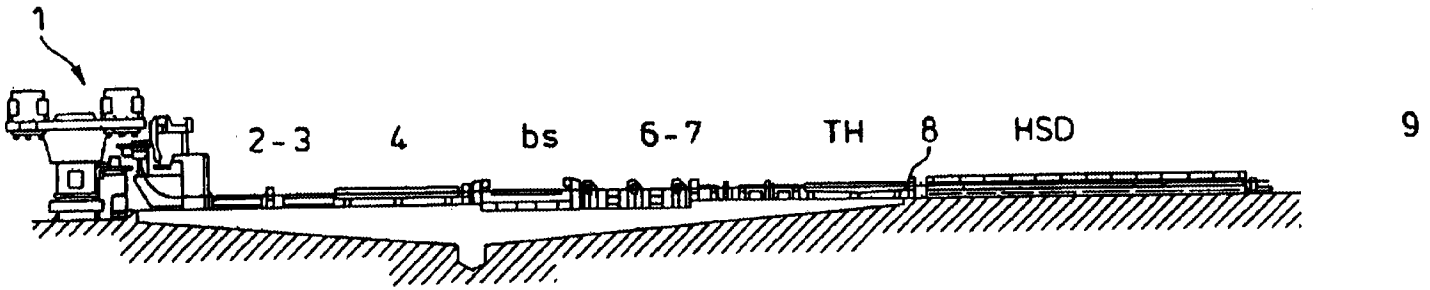
FIG. 1 is a diagrammatic side elevational view of a portion of the line used for the continuous casting and hot rolling parallel production of multiple metal shapes according to the invention.
Figure 4:
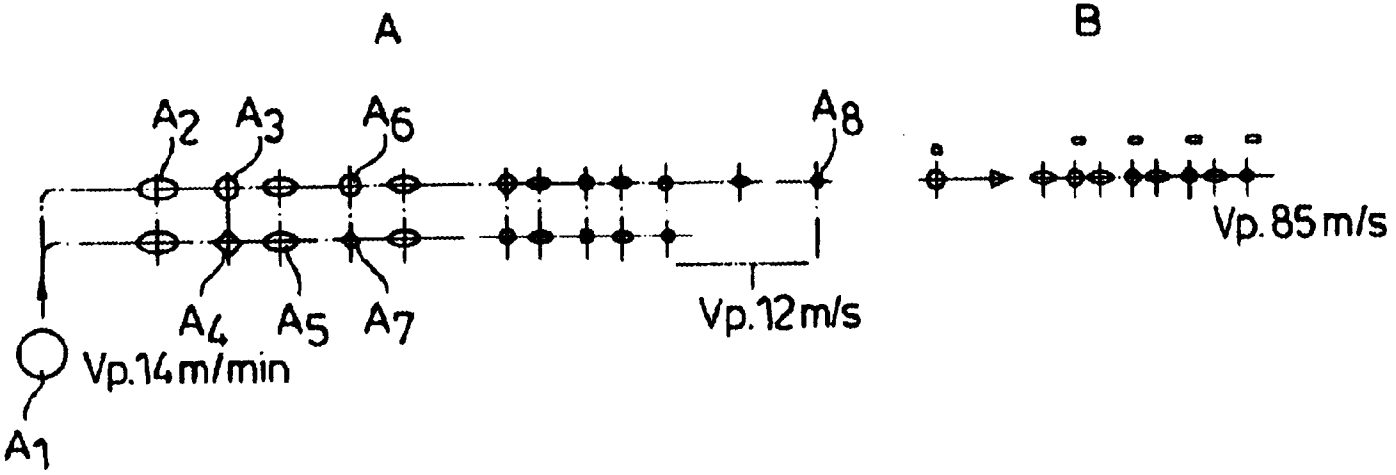
FIG. 4 is a diagram showing schematically the variations in the sections of the products and the increasing linear speeds (corresponding the final rolling speeds)

In FIGS. 1, 1*a* and 4, I have shown at A and B the shaping and reduction of a continuously cast originally round strand in the first hot rolling section (stage A) and in the second wire rolling section (stage B) with the final roll speed or the linear speed of the stock in each case. Thus, for example, as the stock is originally continuously cast with the circular cross section $A_1$ and has a linear speed of 14 m/min before it enters the first of the rolling mill stands 6, it can be rolled into an oval $A_2$ and then by a vertical roll into a circular pattern $A_3$ or a rhomboid pattern $A_4$ and then into oval patterns $A_5$, a circular pattern $A_6$ or another polygonyl shape $A_7$, ultimately into a wire shape at $A_8$ in which its linear speed has increased to 12 min per second which corresponds to the speed of the final roll in the stretch 6, 7. In the universal mill stage represented at um in FIGS. 2 and 2*a* and shown in FIG. 7*a*, the hot rolling is effected to produce the stages $B_1$ through $B_{10}$ with an increase in the linear speed from 12 m per second to 85 m per second and corresponding cross sectional reduction.

The hot rolling line 6 to 7 has only been illustrated diagrammatically and a difference between the system of FIGS. 1 and 2 and that of FIGS. 1*a* and 2*a* is that the first section of the hot rolling line 6 in FIGS. 1*a* and 2*a* consists of horizontal roll stands and means is, therefore, provided for rotating the strands through 90° to effect rolling in two mutually perpendicular directions. That means has been represented at iv. In FIGS. 1 and 2, the vertical and horizontal roll stands alternate with one another in both segments of the hot rolling line portion of the apparatus.

I claim:

1. An apparatus for the parallel production of different metal shapes, said apparatus comprising:

a flow-former having n mutually adjacent but separate shaping passages for producing a corresponding number of continuous metal strands of different cross sections, where n is an even number but at least equal to 2 or >2;

an extractor including at least one pair of pinch rollers below said flow-former for drawing said strands from said passages;

a tunnel-shaped preheating induction furnace downstream of said extractor and traversed by said strands for heating said strands to hot-rolling temperature;

a hot-rolling line downstream of said induction furnace and comprising a multiplicity of roll stands successively engaging said strands and having rolls oriented for reducing cross sections of said strands in at least two different directions so that a width of 60 to 70 mm of each strands is reduced to about 12 mm with an increase of peripheral speed of the rolls at an inlet to said line of about 14 m/min to a peripheral speed of the rolls of about 12 m/sec at an outlet of said line;

at least n/2 universal rolling units downstream of said hot-rolling line and each comprised of 12 roll-pair groups oriented along two rolling lines and with alternating rolling of a pair of said strands in two mutually perpendicular directions for rolling same with a final peripheral roll speed of about 85 m/sec, each of said universal rolling units including rows of first stands driven by common shafts located at base vertices of an isosceles triangle and another row of stands driven by a common shaft located along an apical vertex of said isosceles triangle and having rolls alternating with the rolls of the first stands along said two rolling lines; and loop control systems between said hot-rolling line and the apparatus upstream thereof and between said hot-rolling line and said units for compensating for speed variations between relatively upstream and downstream parts of the apparatus.

2. The apparatus defined in claim 1 wherein said flow-former is a continuous caster and said passages are continuous casting molds producing said strands.

3. The apparatus defined in claim 2 wherein said hot-rolling line comprises a first segment with a plurality of horizontal-roll mill stands in succession and a second segment with vertical mill stands alternating with horizontal mill stands, the horizontal mill stands having grooved rollers accommodating all of the strands produced in said continuous caster.

4. The apparatus defined in claim 3 wherein said vertical mill stands have respective pairs of vertical rolls engaging said strands and alternately offset from one another in two rows across said strands, each of said rows having n/2 pairs of vertical rolls.

5. The apparatus defined in claim 2 wherein said hot-rolling line includes a plurality of horizontal roll stands with respective rolling grooves accommodating said strands, and means for rotating said strands through 90° to roll said strands in two mutually perpendicular directions.

6. The apparatus defined in claim 2 wherein said first stands are inclined outwardly in opposite directions and said second stands alternately have opposite inclinations to said first stands and have respective pairs of rollers at right angles to and receiving said rolling lines.

7. The apparatus defined in claim 2, further comprising at least one shear along said line for subdividing at least some of said strands into respective lengths.

* * * * *